United States Patent [19]

Ogawa et al.

[11] Patent Number: 4,471,577

[45] Date of Patent: Sep. 18, 1984

[54] DOUBLE SPINDLE GRINDING MACHINE

[75] Inventors: Isao Ogawa; Masaki Sato; Nobuo Morita; Takeshi Kobayashi, all of Narashino, Japan

[73] Assignee: Seiko Seiki Kabushiki Kaisha, Chiba, Japan

[21] Appl. No.: 337,102

[22] Filed: Jan. 5, 1982

[30] Foreign Application Priority Data

Jan. 14, 1981 [JP] Japan ..... 56-4273

[51] Int. Cl.[3] ..... B24B 7/10

[52] U.S. Cl. ..... 51/3; 51/50; 51/237 T

[58] Field of Search ..... 51/165 R, 165.77, 165.93, 51/3, 5 D, 237 T

[56] References Cited

U.S. PATENT DOCUMENTS

| | | | |
|---|---|---|---|
| 3,924,355 | 12/1975 | Tatsumi | 51/165.77 |
| 4,265,054 | 5/1981 | Ito | 51/165.93 |
| 4,286,413 | 9/1981 | Axelsson | 51/3 |

*Primary Examiner*—Harold D. Whitehead

*Attorney, Agent, or Firm*—Robert E. Burns; Emmanuel J. Lobato; Bruce L. Adams

[57] ABSTRACT

A double spindle grinding machine has a pair of grinding spindles mounted on feed tables for performing two independent grinding operations. A pair of work spindles for holding workpieces to be ground are rotatably mounted on a supporting frame which undergoes angular displacement in forward and reverse directions through an arc of 180° to alternately position the workpieces held by the two spindles opposite alternate ones of the two grinding spindles. A swing shaft is connected to the supporting frame and is alternately driven in forward and reverse directions to displace the supporting frame to extreme forward and reverse positions so as to alternately position the workpieces in opposed relation to alternate ones of the grinding spindles. A clamping device coacts with the supporting frame to releasably clamp the frame in either extreme position, and the clamping device includes a pair of vertically slidable clamp rods connected through a linkage to a reciprocal fluid motor which effects upward and downward movement of the clamp rods between unclamping and clamping positions. A clamp block is secured to each clamp rod and coacts with a clamp member secured to the supporting frame to releasably clamp the frame in the extreme forward and reverse positions in response to actuation of the fluid motor to drive the clamp rods to the clamping positions.

9 Claims, 4 Drawing Figures

DOUBLE SPINDLE GRINDING MACHINE

BACKGROUND OF THE INVENTION

The present invention relates to a double spindle grinding machine able to grind two works of the same shape simultaneously by a single grinding machine.

The interiors of the nozzle parts in a diesel engine, for example, have tapered front ends and cylindrical portions. To grind each internal portion precisely, two processes of grinding are required. In the conventional grinding machine, however, only one grinding spindle is provided for each workpiece in most cases, so that only one work can be grinded during one working process of a grinding machine even by speeding up the working process of the grinding machine. In the case where plural working processes are required to be performed on one work, it is impossible to yield double or triple productivity by each grinding machine since the grinding speed of each grinding machine is limited.

On the contrary, the multi-spindle grinding machine has recently been developed, in which plural work spindles located opposite respectively to plural grinding spindles are held by a drum, and each work is grinded simultaneously to perform one working process, and the drum is incrementally rotated unidirectionally via a Geneva device or the like intermittently after each one working process is finished. The multi-spindle grinding machine has the advantage of speeding up the working in comparison with the conventional type since plural working processes are carried out by one grinding machine.

However, the multi-spindle grinding machine has various drawbacks as follows.

(1) Since the drum which holds the plural work spindles intermittently rotates unidirectionally, it is necessary to move a stopper of a positioning device during the course of each increment of rotation to be in contact with or spaced from the drum. As a result, the positioning device is complicated and the accuracy of positioning is deteriorated.

(2) As the drum rotates unidirectionally, the piping and wiring of the lubricating system towards each work spindle and the automatic chucking device of the works are complicated.

(3) Since the driving motors of each of the work spindles are mounted on the drum, the movement of the drum slows down by the weight of the motors.

(4) It is necessary to provide the driving motors corresponding to the respective work spindles to make a difference in the grinding conditions.

The present invention aims to eliminate the above noted conventional drawbacks of the multi-spindle grinding machine, and therefore it is an object of the present invention to provide a double spindle grinding machine able to work two workpieces simultaneously in two processes at a high speed and high precision. The double spindle grinding machine is realized by reversing at least a pair of work spindles symmetrically provided on a supporting frame fixed on a swing shaft at 180° after one working process is finished and positioning the pair of work spindles again opposite to respective grind stones, whereby a stopper of a positioning device is fixed, and the piping and wiring mechanism of the lubricating system is simplified. The motors for driving the work spindles are separately provided by transmitting the rotation of the work spindles to a center of rotation of the swing shaft by way of a coaxial intermediate shaft.

Hereinafter an embodiment of the present invention will be illustrated in conjunction with the drawings.

Figure 1:
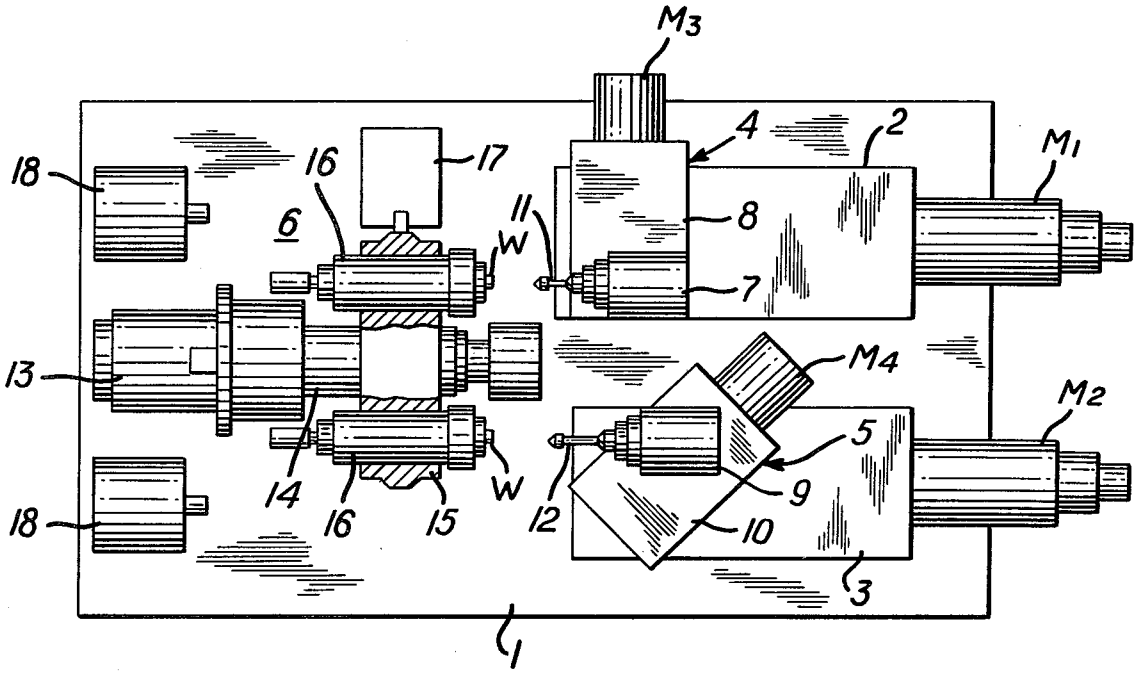
FIG. 1 shows a schematic plan view showing the overall structure of the double spindle grinding machine according to the present invention.

FIG. 1 shows an overall structure of a double spindle internal grinding machine according to the present invention, comprising a bed 1, a pair of feed tables 2 and 3 arranged in parallel on the bed 1 and driven by direct-current servo-motors $M_1$ and $M_2$, grinding spindle attachments 4 and 5 mounted on the feed tables 2 and 3, and a work holder 6 mounted on the bed 1 at a location intermediate the feed tables 2 and 3.

The spindle attachment 4 is for grinding an internal cylindrical portion of a workpiece or work W. A spindle motor 7 (a spindle incorporating a motor and referred to as a spindle motor hereafter) is mounted on the feed table 2 meeting at a right angle with it and fixed on a grinding feed table 8 which is driven by a pulse motor $M_3$.

The other spindle attachment 5 is for grinding a taper of an internal cylindrical portion of a work W. A spindle motor 9 is mounted on the feed table 3 at an angle corresponding to the taper and fixed on a grinding feed table 10 which is driven by a pulse motor $M_4$. Grind stones 11 and 12 are held respectively by the front ends of the spindle motors 7 and 9 and have cylindrical and tapered shapes corresponding to the works W.

The work holder 6 comprises a turnable swing shaft 14 reversely driven in opposite directions through 180° by a direct-current servo-motor 13 provided at a rear end, a supporting frame 15 fixed on the swing shaft 14 and meeting at a right angle thereto , a clamping device 17 provided at one side of the frame 15 to clamp the frame 15 in contact with it during each 180° swing, and driving motors 18, 18 for each work spindle attachment 16 and being fixed on the bed 1 at both sides of the direct-current servo-motor 13. Works W are chucked at the front ends of the work spindle attachments 16 opposite respectively to the grind stones 11 and 12.

Figure 2:
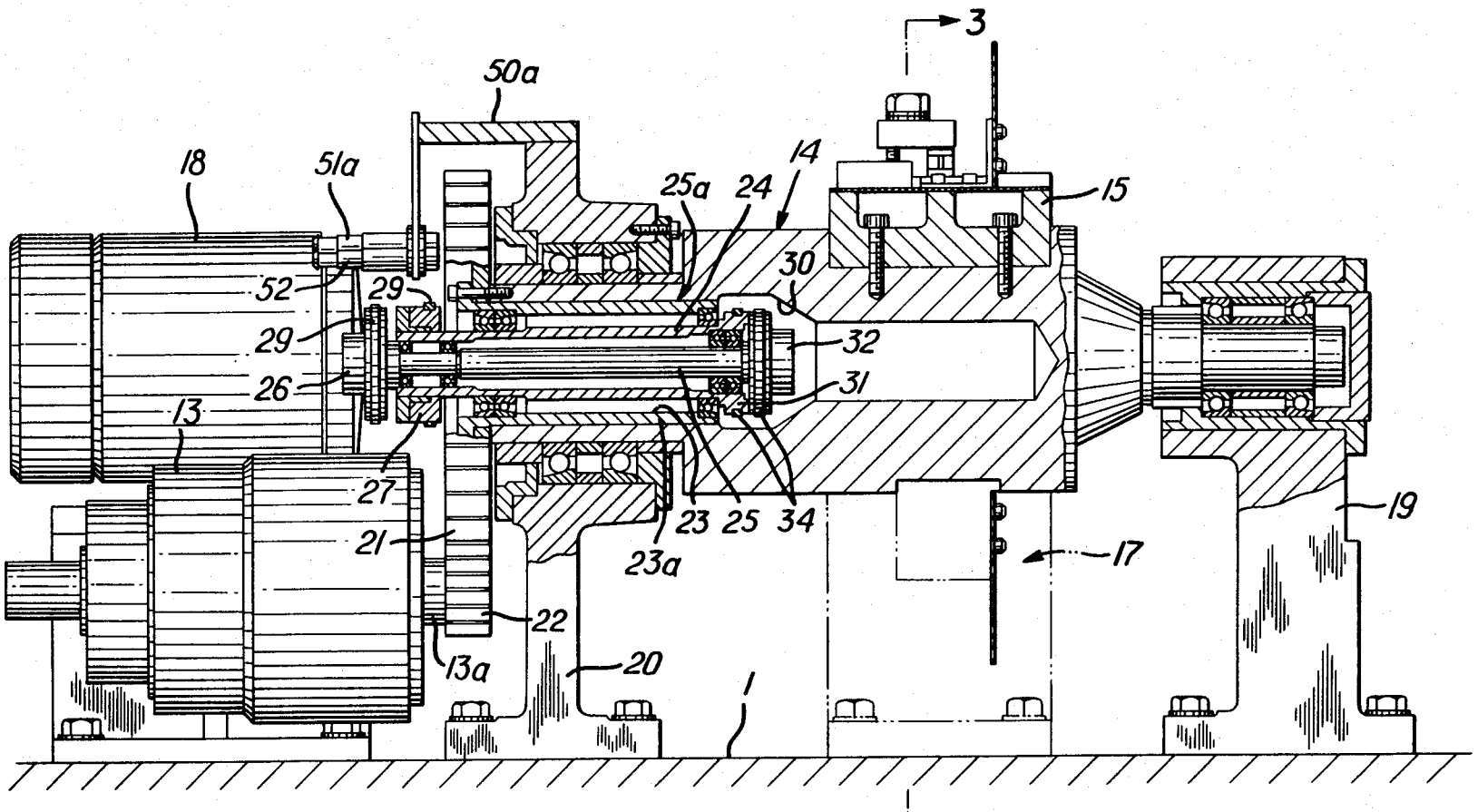
FIG. 2 shows a longitudinal section of the work holder in the double spindle grinding machine.

The front and rear ends of the swing shaft 14 are supported rotatably by bearing frames 19 and 20 as shown in FIG. 2, and a gear 21 of large diameter is fixed to the rear end surface of the swing shaft 14 to engage with a pinion 22 fixed to an output shaft 13*a* of the direct-current servo-motor to transmit the power, and the swing shaft 14 is alternately driven in forward and reverse directions in 180° arcs to angularly displace the supporting frame 15 between a forward end or limit position and a reverse end or limit position by the servo-motor 13 after the finish of each one-cycle working process.

A fixed sleeve 23*a* at the center of the swing shaft 14 and the gear 21 are provided with a through hole 23 along the direction of the shaft. A first intermediate shaft 24 of hollow cylindrical shape is rotatably supported in the through hole 23 via a bearing or the like. A second intermediate shaft 25 is rotatably supported in an internal cylindrical portion of the first intermediate shaft 24 coaxially via a bearing or the like. An intermediate shaft portion is composed of the intermediate shafts 24 and 25.

Pulleys 26 and 27 are rotatably mounted at the rear projection ends of the first and the second intermediate shafts 24 and 25 respectively, and belts 29 and 29 are respectively passed around the pulleys 26 and 27 and pulleys 28 and 28 (referred to in FIG. 4) rotatably provided on the driving motors 18, 18, whereby the rotation of the motors 18 are transmitted to the intermediate shafts 24 and 25. The through hole 23 of the swing shaft 14 is reamed at the front end sides of the intermediate shafts 24 and 25, and window portions 30 are provided at both sides of the swing shaft 14 in the direction meeting at a right angle with the core of the swing shaft. Pulleys 31 and 32 are also provided at the front ends of the intermediate shafts 24 and 25. The rotation of the work spindle attachments 16 are transmitted by belts 34 and 34 passed around the pulleys 31, 32 and 33, 33 rotatably provided at the rear end of the work spindle attachments 16 and 16 through the window portions 30 as shown by two dot chain lines in FIG. 3. Reference numerals 35 in FIG. 3 denote tension pulleys for the belts 34.

The clamping device 17 comprises a fixed frame 36 provided on the bed 1, a pair of slidable clamp rods 37 and 38 extending in the upper and lower directions in parallel with the fixed frame 36 and mounted to be vertically slidable, and a reciprocal fluid motor in the form of an air cylinder 39 supported at the rear side of the fixed frame 36.

A contact block portion 40 comprising symmetrical upper and lower portions is made in one piece with the fixed frame 36 at the front end thereof, and stopper blocks 41, 41 are fixed to the upper and lower ends of the contact block portion 40. The stopper blocks 41 contact with heads of screws 42 and 42 screwed through both ends of the supporting frame 15 to thereby determine the end positions of the supporting frame 15 when it is turned back and forth through the 180° angle of displacement.

The clamp rods 37 and 38 are respectively connected to a piston rod 43 provided at the front end of the air cylinder 39 so as via link levers 44 and 45 in response to slide vertically regular and irregular drive of the piston (not shown) within the cylinder 39. A pair of clamp blocks 46 and 47 are disposed opposite to a pair of clamp members which comprise the screw heads 42 and are screwed on the front ends of the rods 37 and 38 to clamp and unclamp the screw heads 42 by the lower end surfaces of each of the clamp blocks 46 and 47 in accordance with the piston drive.

Figure 3:
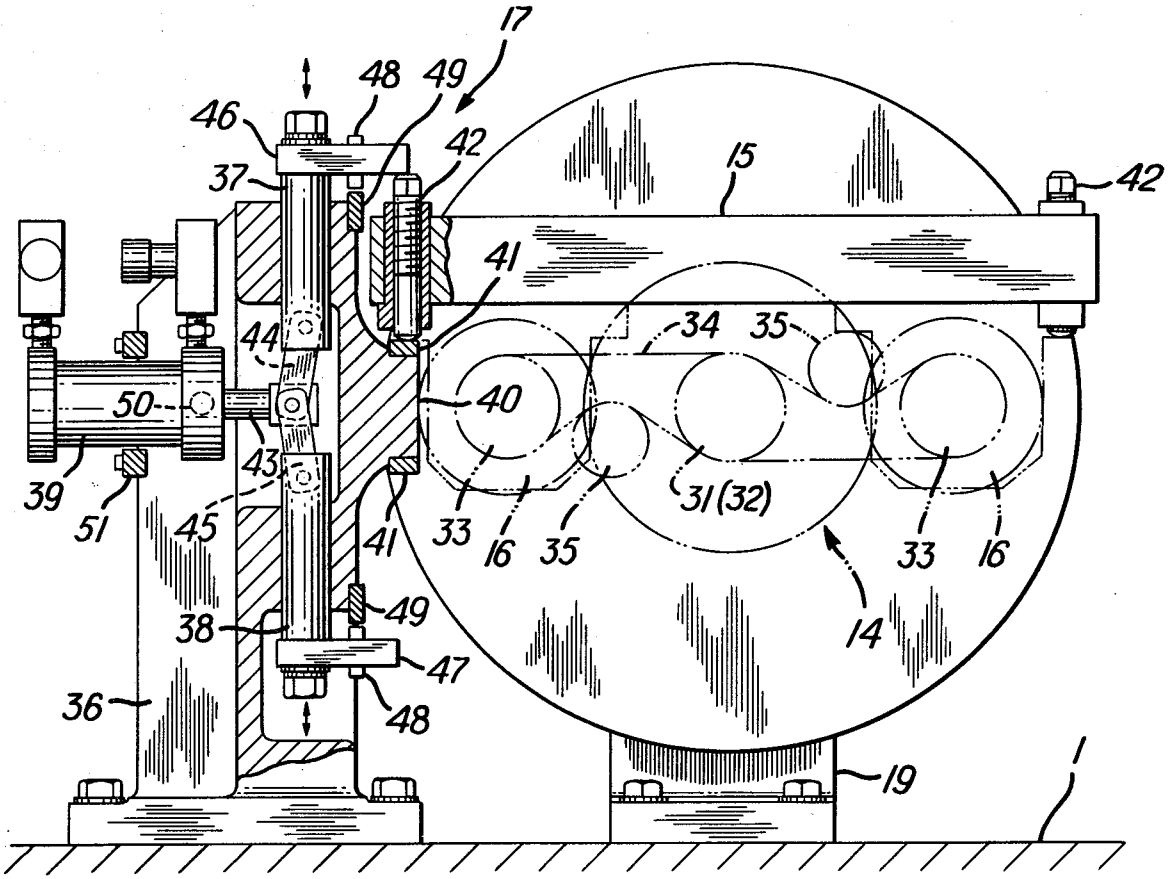
FIG. 3 shows a sectional view taken on line 3—3 of FIG. 2.
Figure 4:
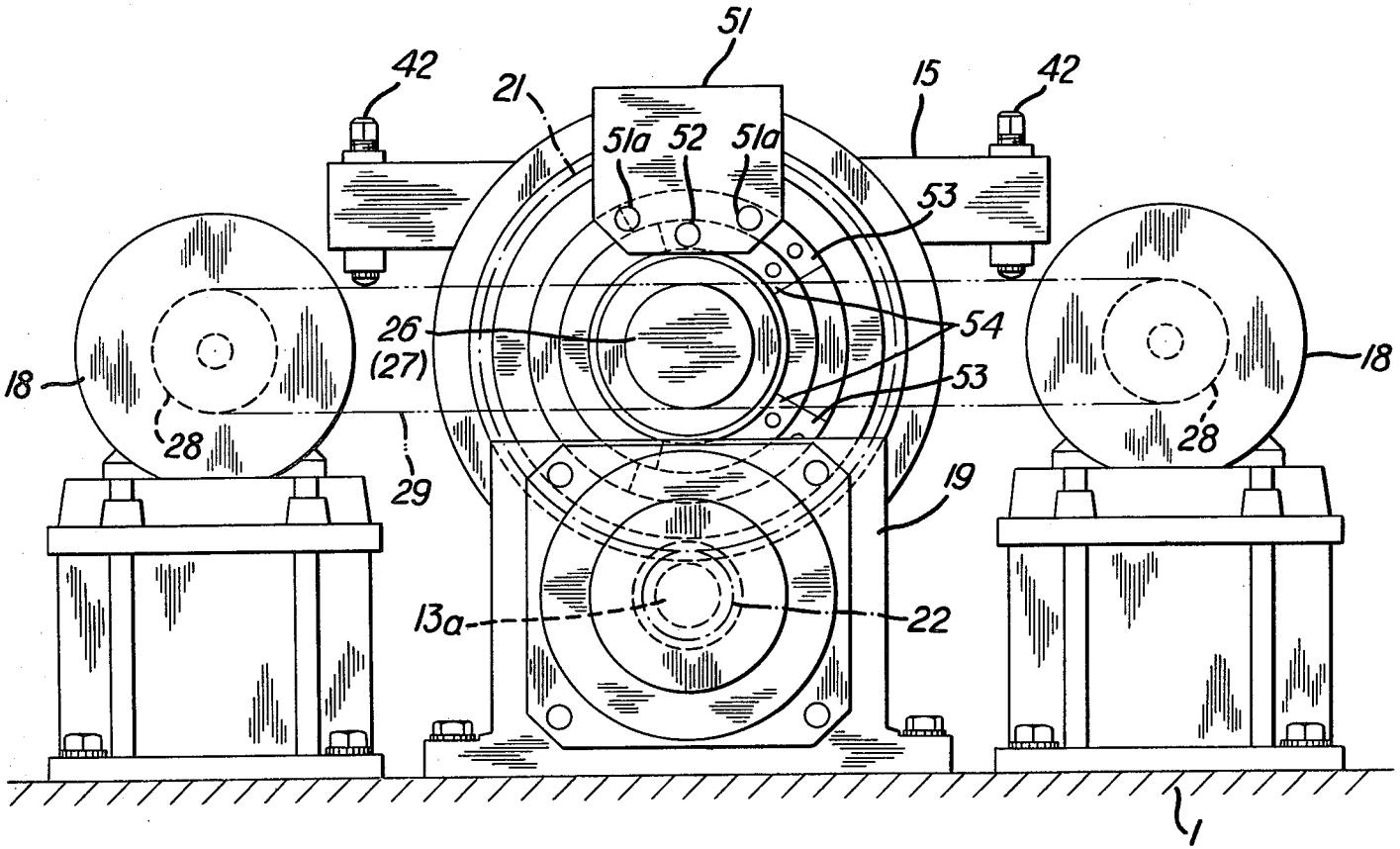
FIG. 4 shows a rear elevation of the work holder of FIG. 2.

In FIG. 3, reference numerals 48, 48 are stopper screws screwed through the clamp blocks 46 and 47, numerals 49 and 49 denote second stopper blocks fixed on upper and lower shoulders of the fixed frame 36 opposite to the stopper screws 48 and 48. While the one clamp block 46 is in contact with one of the screw heads 42, the other clamp block 47 is in contact with the second stopper block 49 and this condition defines the forward end position of the shaft 14 and the supporting frame 15.

When the one clamp rod 46 is clamping, a minute clearance is formed between the stopper screw 48 and the stopper block 49. To absorb the balance of the travelled distance between the rods 37 and 38 corresponding to the clearance, both sides of the air cylinder 39 are supported to be swung by way of a shaft 50, and the rear portion of the cylinder 39 is loosely supported by a supporting block 51.

Accordingly the one cycle working process of each work W is carried out under the clamping condition shown in FIG. 3. When the grind stones 11 and 12 are stepped back to a work-waiting position, the waiting position is detected by a limit switch, and the cylinder 39 is driven by the output signal of the limit switch, and the clamp rods 37 and 38 are actuated and respectively lifted and lowered to unclamp the supporting frame 15. Then the swing shaft 14 is angularly displaced or turned 180° in the reverse direction by the direct-current servo-motor 13, and the swing shaft 14 is positioned so that the opposite positioning screw 42 is in contact with the lower stopper block 41 thereby defining the reverse end position of the shaft 14 and the supporting frame 15. And then the cylinder 39 is driven in the opposite direction to actuate the clamping operation of the lower clamp block 47. The servo-motor 13 has to be driven so that the swing shaft 14 rapidly swings, and retards at the stage before it is in contact with the stopper 41, and is zero at the stage just before it is contact with the stopper 41.

The detecting means for the turning angle of the swing shaft comprises first proximity switches **51*a* and 51*a* for detecting the driving direction and a common second proximity switch 52 opposite to a rear end surface of the gear 21; and first and second dog plates 53, 53, 54 and 54 of different circumferences annularly positioned and fixed corresponding respectively to the regular and irregular stop positions at the ends of the gear 21** opposite to each proximity switch.

The first proximity switch **51*a* corresponds to the first dog plate 53 and the second proximity switch 52 corresponds to the second dog plate 54. The swing shaft 14 is turned by the rotation of the servo-motor 13, and when the servo-motor 13 rotates the shaft 14 in the proximity of the rotation stop position, the second dog plate 54 is detected by the second proximity switch 52. The velocity of rotation of the servo-motor 13 retards upon receiving the detection signal, and when the swing shaft 14 turns to the rotation stop position (the position in contact with the stopper), the first dog plate 53 is detected at the first proximity switch 51*a*, and the servo-motor 13 stops rotating upon receiving the detection signal. Further the air cylinder 39 is driven in response to the detection signal to carry out the clamping operation, and the works W are positioned opposite to the respective grind stones 11 and 12** at the symmetrical position to the above, and the next working cycle is carried out at this stage.

As illustrated so far, in the double spindle grinding machine according to the present invention, at least a pair of work spindles are symmetrically provided on the supporting frame fixed on the main shaft and are positioned opposite to the grind stones again at the reverse position by reversing the main shaft 180° after one work is finished, whereby two works can be worked simultaneously in two processes. And as a result the stoppers of the positioning device of the swing shaft are fixedly provided and the swing shaft can be positioned precisely. Since the swing shaft can be repeatedly reversed in 180° arcs, the piping and wiring of the lubricating system for the work spindle attachments and the automatic clamping device for the works are easily realized in comparison with the conventional unidirectional rotation type and the mechanism is simplified and the cost is reduced.

According to the present invention the rotation of the work spindle attachments is transmitted by the coaxial intermediate shafts to the center of rotation of the main shaft, whereby the driving motors for the work spindles can be provided separately. As a result, the structure which undergoes reverse motion is reduced in weight enough to be reversed at a high speed. Each spindle shaft can be driven and controlled separately by the coaxial intermediate shafts, and thereby the working efficiency is easily improved.

Since the swing shaft is directly driven by the servomotor via a gear, the mechanism is simplified in comparison with the conventional type driven via the Geneva device or the like, whereby the velocity of rotation and the acceleration is freely controlled during the reverse driving.

Accordingly, the double spindle grinding machine according to the present invention is very suitable for grinding the inner surfaces of the works accurately at a high speed in two processes, such as nozzle parts in a diesel engine.

We claim:

1. In a double spindle grinding machine having a pair of grinding means mounted on a bed for simultaneously grinding a pair of workpieces: a supporting frame; means mounting the supporting frame for angular displacement in forward and reverse directions about a given axis between forward and reverse end positions; a pair of work spindles rotatably mounted on the supporting frame in spaced-apart symmetrical relation relative to the given axis and each having means for releasably holding a workpiece; means for angularly displacing the supporting frame about the given axis in forward and reverse directions to the forward and reverse end positions to alternately position the pair of work spindles in opposed relation to opposite ones of the pair of grinding means; and clamping means for releasably clamping the supporting frame in both the forward and reverse end positions, the clamping means comprising a pair of slidable clamp rods slidable in opposite directions between clamping and unclamping positions, means on the clamp rods for clampingly engaging with means on the supporting frame when the clamp rods are in the clamping position to releasably clamp the supporting frame in the forward and reverse end positions, and actuating means for simultaneously actuating the clamp rods to the clamping and unclamping positions.

2. A double spindle grinding machine according to claim 1; wherein the actuating means includes a pair of link levers each pivotably connected at one end to respective ones of the clamp rods, and means pivotably connected to the other ends of the link levers for selectively displacing the link levers to thereby effect sliding movement of the clamp rods to the clamping and unclamping positions.

3. A double spindle grinding machine according to claim 2; wherein the means for selectively displacing the link levers comprises a reciprocal fluid motor.

4. A double spindle grinding machine according to claim 2; wherein the means on the clamp rods for clampingly engaging with means on the supporting frame comprises a clamp block connected to and projecting transversely of each clamp rod, and the means on the supporting frame comprises a pair of clamp members suitably positioned in spaced-apart relation such that one clamp block is engageable with one clamp member when the supporting frame is in the forward end position and the other clamp block is engageable with the other clamp member when the supporting frame is in the reverse end position.

5. A double spindle grinding machine according to claim 4; including means adjustably mounting the clamp blocks and clamp members to enable adjustment of the position at which the clamp blocks make engagement with the clamp members.

6. A double spindle grinding machine according to claim 5; wherein the clamp members comprise screw-threaded members threaded into the supporting frame.

7. A double spindle grinding machine according to claim 1; wherein the means on the clamp rods for clampingly engaging with means on the supporting frame comprises a clamp block connected to and projecting transversely of each clamp rod, and the means on the supporting frame comprises a pair of clamp members suitably positioned in spaced-apart relation such that one clamp block is engageable with one clamp member when the supporting frame is in the forward end position and the other clamp block is engageable with the other clamp member when the supporting frame is in the reverse end position.

8. A double spindle grinding machine according to claim 7; including means adjustably mounting the clamp blocks and clamp members to enable adjustment of the position at which the clamp blocks make engagement with the clamp members.

9. A double spindle grinding machine according to claim 8; wherein the clamp members comprise screw-threaded members threaded into the supporting frame.

* * * * *